US007937958B2

(12) United States Patent
Shinya et al.

(10) Patent No.: US 7,937,958 B2
(45) Date of Patent: May 10, 2011

(54) METHOD OF MANUFACTURING LOW-TEMPERATURE STORAGE, AND LOW-TEMPERATURE STORAGE

(75) Inventors: Hidetoshi Shinya, Gunma-ken (JP); Yasushi Sakata, Tatebayashi (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 0 days.

(21) Appl. No.: 12/801,067

(22) Filed: May 20, 2010

(65) Prior Publication Data

US 2010/0230423 A1 Sep. 16, 2010

Related U.S. Application Data

(63) Continuation of application No. 11/546,279, filed on Oct. 12, 2006, now abandoned.

(30) Foreign Application Priority Data

Oct. 13, 2005 (JP) ..... 2005-298722

(51) Int. Cl.
*F25B 1/00* (2006.01)

(52) U.S. Cl. ..... 62/115; 62/440; 62/457.9

(58) Field of Classification Search ..... 62/77, 115, 62/438, 440, 457.9, 498, DIG. 13; 220/592.02, 220/592.09, 592.1, 592.26, 592.27, DIG. 9, 220/DIG. 18; 312/401, 406; 29/890.035
See application file for complete search history.

(56) References Cited

U.S. PATENT DOCUMENTS

| | | | | |
|---|---|---|---|---|
| 3,813,896 | A * | 6/1974 | Lebahn | 62/409 |
| 5,335,425 | A * | 8/1994 | Tomizawa et al. | 34/265 |
| 5,512,345 | A * | 4/1996 | Tsutsumi et al. | 428/69 |
| 5,632,543 | A * | 5/1997 | McGrath et al. | 312/406 |
| 5,979,693 | A * | 11/1999 | Bane, III | 220/592.2 |
| 6,109,712 | A * | 8/2000 | Haworth et al. | 312/400 |
| 6,397,620 | B1 | 6/2002 | Kelly et al. | 62/275 |
| 6,718,776 | B2 * | 4/2004 | Wessling et al. | 62/60 |
| 7,353,960 | B2 * | 4/2008 | Seiter | 220/1.5 |
| 7,434,520 | B2 * | 10/2008 | Zupancich et al. | 105/423 |
| 7,568,353 | B2 * | 8/2009 | Rampersad et al. | 62/51.1 |
| 2004/0180176 | A1 | 9/2004 | Rusek, Jr. | 428/69 |

FOREIGN PATENT DOCUMENTS

| | | |
|---|---|---|
| JP | 8-68591 | 3/1996 |
| JP | 10-141584 | 5/1998 |
| JP | 10-300330 | 11/1998 |
| JP | 2005-048979 | 2/2005 |
| JP | 2005-061465 | 3/2005 |

OTHER PUBLICATIONS

Japanese Office Action dated Jun. 2, 2009.

* cited by examiner

*Primary Examiner* — Mohammad Ali
(74) *Attorney, Agent, or Firm* — Kratz, Quintos & Hanson, LLP

(57) ABSTRACT

An object is to provide a method of manufacturing a low-temperature storage in which an insulating performance of an insulating box article is enhanced, and an amount of contents of an inner box can be enlarged. In the low-temperature storage comprising: the insulating box article constituted by placing a foamed insulating material between an outer box and the inner box; and a vacuum insulating panel disposed on the surface of the outer box on the side of the foamed insulating material, a thickness dimension of the foamed insulating material between the inner box and the vacuum insulating panel is set so that a temperature of the surface of the vacuum insulating panel on the side of the inner box is not less than a predetermined temperature.

5 Claims, 5 Drawing Sheets

METHOD OF MANUFACTURING LOW-TEMPERATURE STORAGE, AND LOW-TEMPERATURE STORAGE

RELATED APPLICATIONS

This application is a continuation of U.S. application Ser. No. 11/546,279, filed Oct. 12, 2006 now abandoned, which application claims priority of Japanese Application No. 2005-298722, filed Oct. 13, 2005, all of which are incorporated herein by reference.

BACKGROUND OF THE INVENTION

The present invention relates to a low-temperature storage constituted of an insulating box article having a foamed insulating material and a vacuum insulating panel between an outer box and an inner box, and a method of manufacturing the low-temperature storage, more particularly to a low-temperature storage in which the inside of an inner box is set to an extremely low temperature of, for example, −80° C. or less.

Heretofore, in the insulating box article constituting a low-temperature storage such as a refrigerator or a freezer, a space constituted by combining an inner box and an outer box is filled with a foamed insulating material to reduce a leakage of cold in the inner box. At this time, a temperature difference between the outside and the inside of the inner box is considered in determining a thickness of the insulating material to fill between the inner box and the outer box. However, to keep the temperature in the inner box at an extremely low temperature of, for example, −80° C. or less, a considerable thickness of the insulating material has to be secured. Therefore, to secure a storage amount of a storage chamber of the inner box, the low-temperature storage itself is enlarged, and power consumption is large.

To solve the problem, as a technique for reducing a thickness dimension of the insulating box article, a vacuum insulating material is disposed in a space between the inner box and the outer box, and gaps among them are filled with a foamed insulating material such as urethane foam (see Japanese Patent Application Laid-Open No. 8-68591). This vacuum insulating material is constituted by putting, in a bag-like container constituted of a multilayered film, a gas-permeable bag including an inorganic fine powder and preliminarily formed into a predetermined shape; discharging air from the bag; and then heat-sealing the bag. In consequence, there is obtained an insulating capability greater than an insulating effect obtained by filling the gaps with the usual foamed insulating material, which makes it possible to reduce the thickness dimension of the insulating box article.

However, in the method of disposing the conventional vacuum insulating material in the insulating box article, the above-described temperature in the inner box is set to an extremely low temperature such as −80° C., the cold in the inner box reaches the surface of the bag which covers the vacuum insulating material, and the temperature of the surface of the bag lowers below a heat-resistant temperature of the bag owing to the cold. As a result, thermal contraction occurs, and the bag itself is destroyed. Therefore, the main body of the vacuum insulating material cannot exert its insulating capability. In consequence, the above method cannot maintain the insulating effect.

SUMMARY OF THE INVENTION

Therefore, to solve the conventional technical problems, an object of the present invention is to provide a low-temperature storage and a method of manufacturing a low-temperature storage in which an insulating performance of an insulating box article is enhanced, and an amount of contents of an inner box can be enlarged.

According to a first invention of the present application, in a method of manufacturing a low-temperature storage comprising: an insulating box article constituted by placing a foamed insulating material between an outer box and an inner box; and a vacuum insulating panel disposed on the surface of the outer box on the side of the foamed insulating material, a thickness dimension of the foamed insulating material between the inner box and the vacuum insulating panel is set so that a temperature of the surface of the vacuum insulating panel on the side of the inner box is not less than a predetermined temperature.

In the method of manufacturing the low-temperature storage in a second invention of the present application, the above invention is characterized in that the thickness dimension of the foamed insulating material is set so that the temperature of the surface of the vacuum insulating panel on the side of the inner box is not less than a low-temperature-resistant limit temperature of the vacuum insulating panel on conditions that a temperature in the inner box is −80° C. or less.

In the method of manufacturing the low-temperature storage in a third invention of the present application, the above invention is characterized in that a glass wool is disposed in a sealed vacuum container to constitute the vacuum insulating panel.

According to a fourth invention of the present application, in a low-temperature storage comprising: an insulating box article constituted by placing a foamed insulating material between an outer box and an inner box; and a vacuum insulating panel disposed in the foamed insulating material, the vacuum insulating panel is constituted by disposing a glass wool in a sealed vacuum container, and the inside of the inner box is cooled at a low temperature of −80° C. or less.

In the low-temperature storage of a fifth invention of the present application, the above invention is characterized in that the vacuum insulating panel is disposed on the surface of the outer box on the side of the foamed insulating material, and a temperature of the surface of the vacuum insulating panel on the side of the inner box is set to be not less than a low-temperature-resistant limit temperature of the vacuum insulating panel.

According to the method of manufacturing the low-temperature storage in the first invention of the present application, in the low-temperature storage comprising: the insulating box article constituted by placing the foamed insulating material between the outer box and the inner box; and the vacuum insulating panel disposed on the surface of the outer box on the side of the foamed insulating material, the thickness dimension of the foamed insulating material between the inner box and the vacuum insulating panel is set so that the temperature of the surface of the vacuum insulating panel on the side of the inner box is not less than the predetermined temperature. Accordingly, a leakage of cold in the inner box can be reduced, and wasting of useless cooling energy can be inhibited.

Moreover, as in the second invention of the present application, even when the temperature in the inner box is −80° C. or less, the thickness dimension of the foamed insulating material is determined so that the temperature of the surface of the vacuum insulating panel on the side of the inner box is not less than a predetermined temperature such as the low-temperature-resistant limit temperature of the vacuum insulating panel. In consequence, while destruction of the vacuum insulating panel itself due to the low temperature can be avoided in advance, the thickness dimension of the insulating box article can further be reduced.

Therefore, even in the low-temperature storage in which the temperature in the inner box is extremely low, an insulating capability of the insulating box article itself is enhanced, and the dimension can be reduced. In consequence, even when an outer-shape dimension is similar to that of a conventional low-temperature storage, a storage volume of the inner box can be enlarged.

According to the third invention of the present application, in the above invention, the glass wool is disposed in the sealed vacuum container to constitute the vacuum insulating panel. Therefore, even when the thickness dimension of the vacuum insulating panel is reduced, a great insulating effect can be obtained. Therefore, the thickness dimension of the insulating box article can further be reduced, and the storage volume of the inner box can be enlarged.

According to the fourth invention of the present application, the low-temperature storage comprises: the insulating box article constituted by placing the foamed insulating material between the outer box and the inner box; and the vacuum insulating panel disposed in the foamed insulating material. The vacuum insulating panel is constituted by disposing the glass wool in the sealed vacuum container, and the inside of the inner box is cooled at the low temperature of −80° C. or less. Therefore, even in the extremely-low-temperature storage in which the inside of the inner box is at −80° C. or less, while the thickness dimension of the insulating box article is reduced, a necessary insulating effect can be obtained. Therefore, while the thickness dimension of the insulating box article is reduced, the low-temperature storage can be constituted so as to prevent a temperature of the outer surface of the outer box from being lowered below a dew point. It is possible to prevent a disadvantage that the outer surface of the outer box is wetted or a disadvantage that the useless cooling energy is wasted owing to the leakage of the cold in the inner box.

Moreover, according to the fifth invention of the present application, in the above invention, the vacuum insulating panel is disposed on the surface of the outer box on the side of the foamed insulating material, and the temperature of the surface of the vacuum insulating panel on the side of the inner box is set to be not less than the low-temperature-resistant limit temperature of the vacuum insulating panel. Therefore, it is possible to avoid in advance the destruction of the vacuum insulating panel itself due to the low temperature.

DETAILED DESCRIPTION OF THE PREFERRED EMBODIMENT

Figure 1:
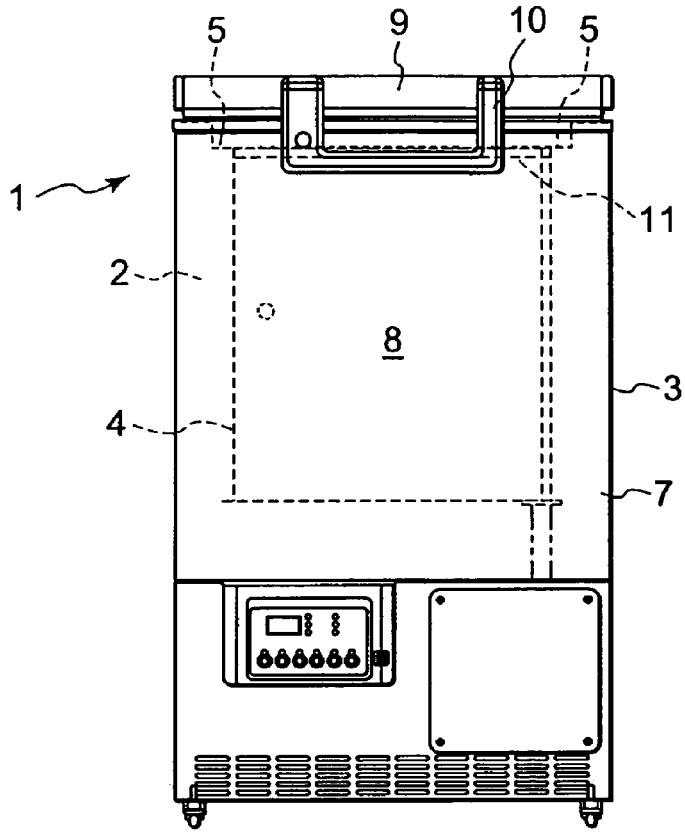
FIG. 1 is a front view of an extremely-low-temperature storage to which the present invention is applied.
Figure 2:
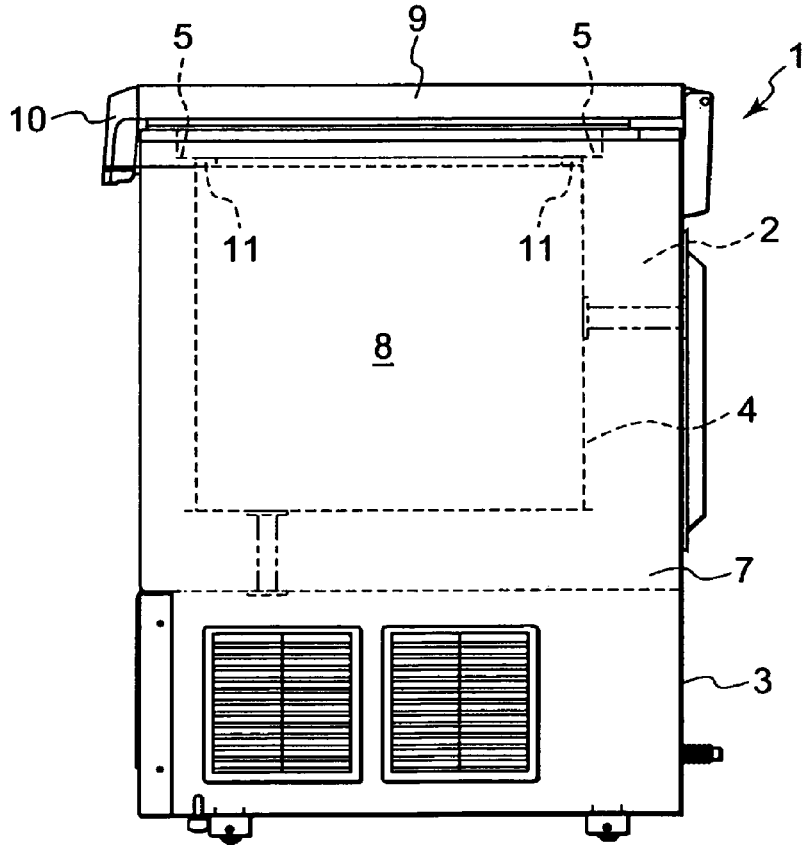
FIG. 2 is a side view of FIG. 1.
Figure 3:
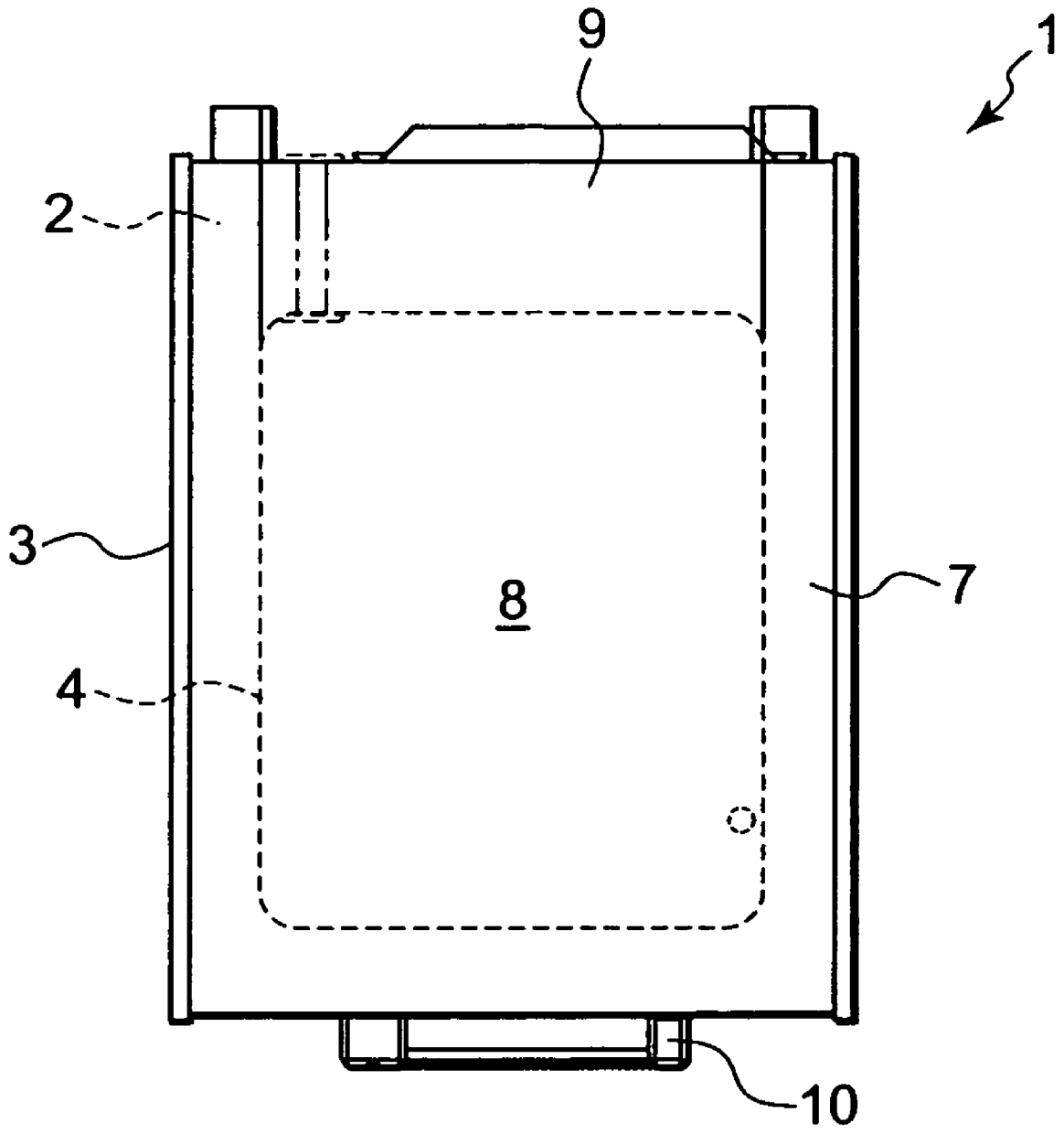
FIG. 3 is a plan view of FIG. 1.

An embodiment of the present invention will be described hereinafter in detail with reference to the drawings. An extremely-low-temperature storage 1 of the present embodiment is used in, for example, storing a frozen food to be stored at a low temperature over a long period or storing a living tissue, a specimen or the like at an extremely low temperature, and a main body of the storage is constituted of an insulating box article 2 having its top opened.

This insulating box article 2 is constituted of: an outer box 3 made of a steel plate; an inner box 4 made of a stainless steel, each of the outer box and the inner box having its top opened; breakers 5 made of a synthetic resin and connecting upper ends of the box 3 to those of the box 4, respectively; and a polyurethane resin insulating material 7 with which a space enclosed by the outer box 3, the inner box 4 and the breakers 5 is filled by an on-site foaming system. The inside of the inner box 4 is a storage chamber 8 having its top opened.

In the present embodiment, to set a targeted temperature in the storage chamber 8 (hereinafter referred to as the in-chamber temperature) at, for example, −80° C. or less, the insulating box article 2 which separates the inside of the storage chamber 8 from outside air requires a great insulating capability as compared with a low-temperature chamber having its in-chamber temperature set in the vicinity of 0° C. Therefore, to secure the insulating capability by the only polyurethane resin insulating material 7, the material has to be formed into a considerable thickness of, for example, about 100 mm. Therefore, there is a problem that a sufficient storage amount of the storage chamber 8 cannot be secured with a limited main-body dimension.

Therefore, in the insulating box article 2 of the present embodiment, a vacuum insulating panel 30 made of a glass wool is disposed on left and right side surfaces of the outer box 3 and a front inner wall surface of the article. The panel is once tentatively fixed with a double-sided adhesive tape, and the insulating material 7 is placed between the panel and both the boxes 3 and 4 by the on-site foaming system.

This vacuum insulating panel 30 is constituted by disposing the glass wool having an insulating property in a container constituted of a multilayered film of aluminum, a synthetic resin or the like which does not have any gas permeability. Thereafter, air is discharged from the container by predetermined vacuum exhaust means, and an opening of the container is heat-sealed. Therefore, according to insulating effectiveness of this vacuum insulating panel 30, while the thickness dimension of the foamed insulating material 7 is reduced as compared with a conventional material, the same insulating effect can be obtained.

Figure 4:
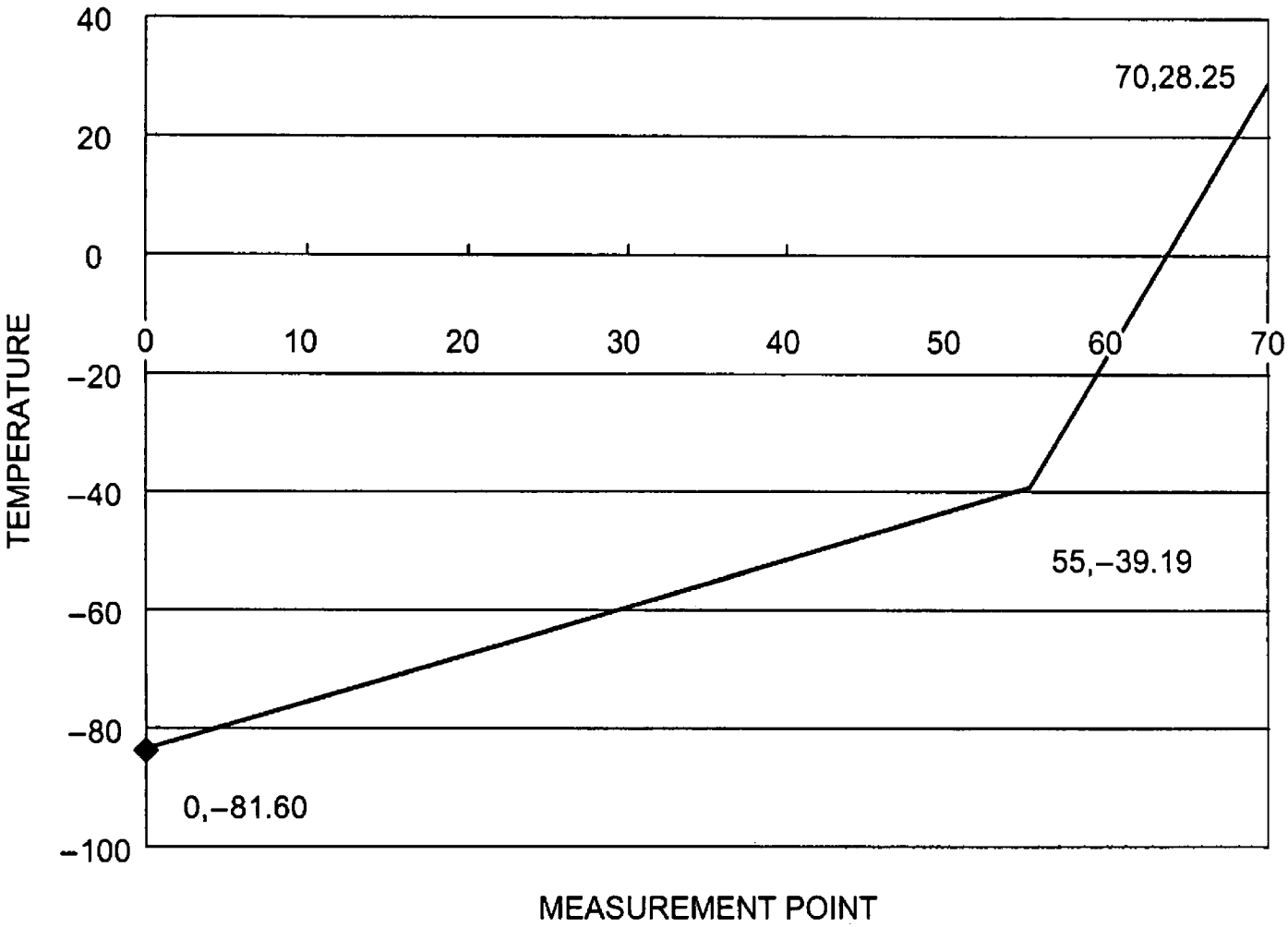
FIG. 4 is a diagram showing a temperature in each thickness position of an insulating box article.

Here, with reference to FIG. 4, there will be described experiment results of temperatures of portions in a case where the vacuum insulating panel 30 having a thickness of 15 mm is used. In this experiment, assuming that a set temperature in the storage chamber 8 was −80° C. and an outside air temperature was +30° C., the temperatures were measured. The vacuum insulating panel 30 manufactured by the above-described method is disposed close to an inner wall of the outer box 3. In the present experiment, since the insulating box article 2 has a thickness of 70 mm, the thickness of the foamed insulating material 7 is set to 55 mm from the inner wall of the inner box.

According to this experiment, the temperature in the storage chamber 8 was −80° C., whereas the temperature of the surface of the inner box 4 (distance of 0 from the inner box 4 surface) was −81.6° C., the temperature of the surface of the vacuum insulating panel 30 on the side of the storage chamber 8 (distance of 55 mm from the inner box 4 surface) was −39.19° C., and the temperature of the surface of the outer box 3 (distance of 70 mm from the inner box 4 surface) was +28.25° C. It is to be noted that the insulating material 7 constitutes a portion ranging from the inner box 4 surface to the surface of the vacuum insulating panel 30 on the side of the storage chamber 8. Therefore, a change of the temperature is proportional to that of the thickness of the portion. Moreover, the vacuum insulating panel 30 constitutes a portion ranging from the surface of the vacuum insulating panel 30 on the side of the storage chamber 8 to the outer box 3 surface. Therefore, it is considered that the change of the temperature is proportional to that of the thickness of the portion.

In a case where a low-temperature-resistant limit temperature of the container in which the vacuum insulating panel 30 is put is, for example, −60° C. to −70° C., when the thickness of the foamed insulating material 7 is about 40 mm, the temperature of the surface of the vacuum insulating panel 30 on the side of the storage chamber 8 can be set to a predetermined temperature of about −50° C. It is possible to securely avoid destruction of the container itself of the vacuum insulating panel 30 due to the low temperature.

Therefore, in the present embodiment, the thickness of the foamed insulating material 7 is set to about 55 mm, and the thickness of the vacuum insulating panel 30 is set to 15 mm as in the present experiment. Accordingly, the temperature of the surface of the vacuum insulating panel 30 on the side of the storage chamber 8 can be set to −39.19° C. which is largely above a heat-resistant temperature. It is possible to securely prevent destruction of the vacuum insulating panel 30 itself due to the low temperature.

Moreover, in this case, if the only insulating material 7 is used, the thickness dimension of the insulating box article 2 needs to be about 100 mm. However, as in the present experiment, the entire thickness dimension can be suppressed to about 70 mm. While the thickness dimension of the insulating box article 2 is reduced, a necessary insulating effect can be obtained. Therefore, even while the thickness dimension of the insulating box article 2 is reduced, it is possible to inhibit a disadvantage that the temperature of the outer surface of the outer box 3 is not more than a dew point. In consequence, even if an outer-shape dimension is similar to a conventional outer-shape dimension, it is possible to remarkably expand a storage volume of the storage chamber 8.

It is to be noted that in a case where the temperature in the storage chamber 8 is set to, for example, −152° C., when the vacuum insulating panel 30 having a thickness of about 15 mm is used, the thickness dimension of the foamed insulating material 7 is set to about 120 mm. Accordingly, it is possible to avoid a disadvantage that the temperature of the surface of the vacuum insulating panel 30 on the side of the storage chamber 8 is the low-temperature-resistant limit temperature of the container in a range of −60° C. to −70° C. Even in this case, while the thickness dimension of the insulating box article 2 is similarly reduced, the necessary insulating effect can be obtained.

It is to be noted that the thickness dimension of the vacuum insulating panel 30 is not limited to the above dimension. Therefore, especially, in a case where the thickness of the vacuum insulating panel 30 is set to about 10 to 20 mm, when the thickness dimension of the foaming insulating material 7 is set to about 40 to 120 mm, it is possible to maintain an insulating performance of the insulating box article 2 in the extremely-low-temperature storage at −80° C. or less, or −150° C. or less.

Figure 5:
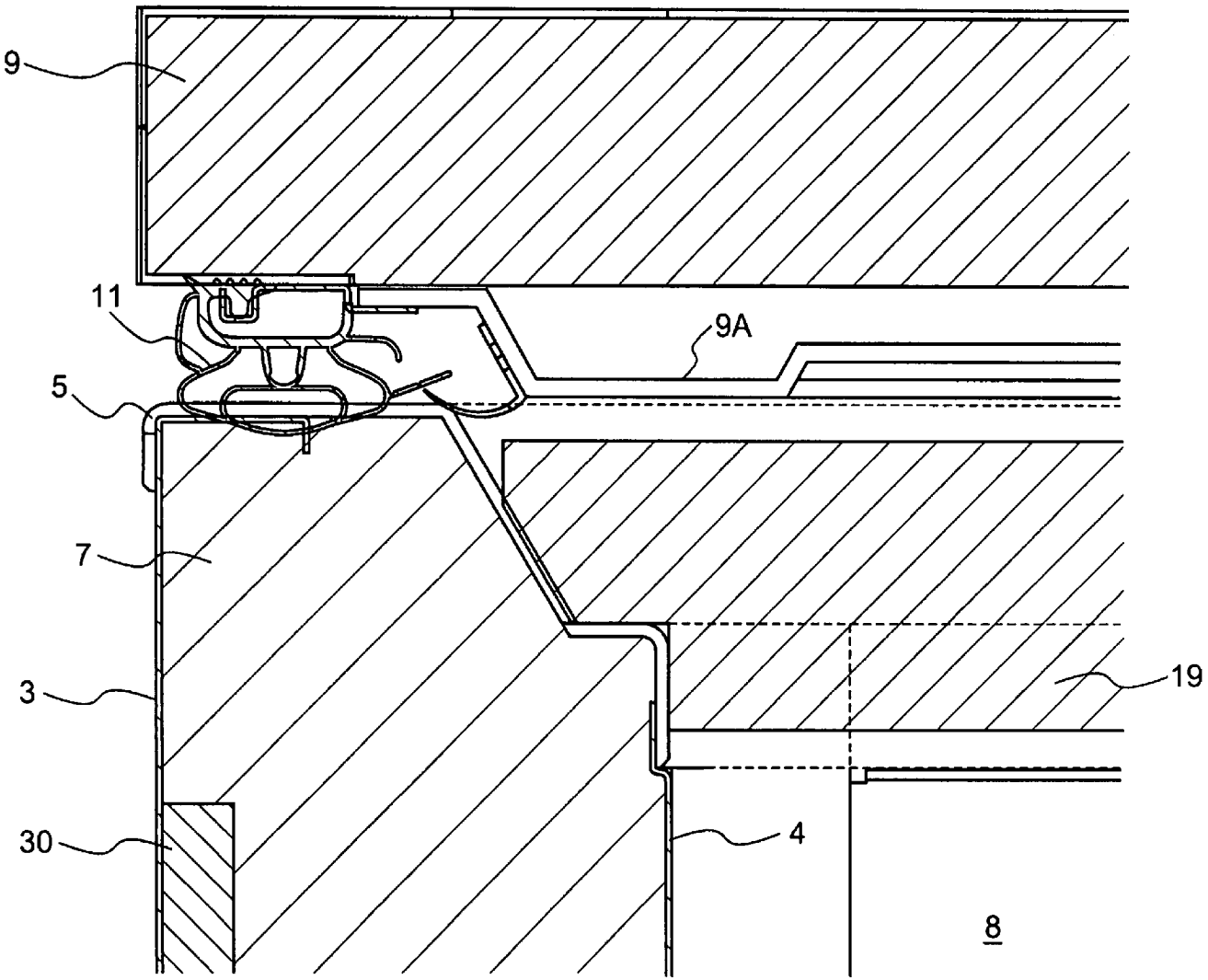
FIG. 5 is a partially enlarged sectional view in the vicinity of an opening.

Moreover, as shown in FIG. 5, the tops of the breakers 5 of the insulating box article 2 constituted as described above are formed into staircase-like shapes, and an insulating door 9 is attached to the breakers via packing members 11 so as to be rotatable centering on one end, that is, a rear end in the present embodiment. An inner lid 19 constituted of an insulating material is disposed so as to open or close an opening in the top of the storage chamber 8. On the underside of the insulating door 9, a pressing portion 9A is formed so as to protrude downwards. Accordingly, after the opening in the top of the storage chamber 8 is closed with the inner lid 19, the insulating door 9 is closed, whereby the pressing portion 9A of the insulating door 9 presses the inner lid 19. In consequence, the opening in the top of the storage chamber 8 is openably closed. A handle portion 10 is disposed on the other end of the insulating door 9, that is, a front end thereof in the present embodiment. When the handle portion 10 is operated, the insulating door 9 is opened or closed.

Figure 6:
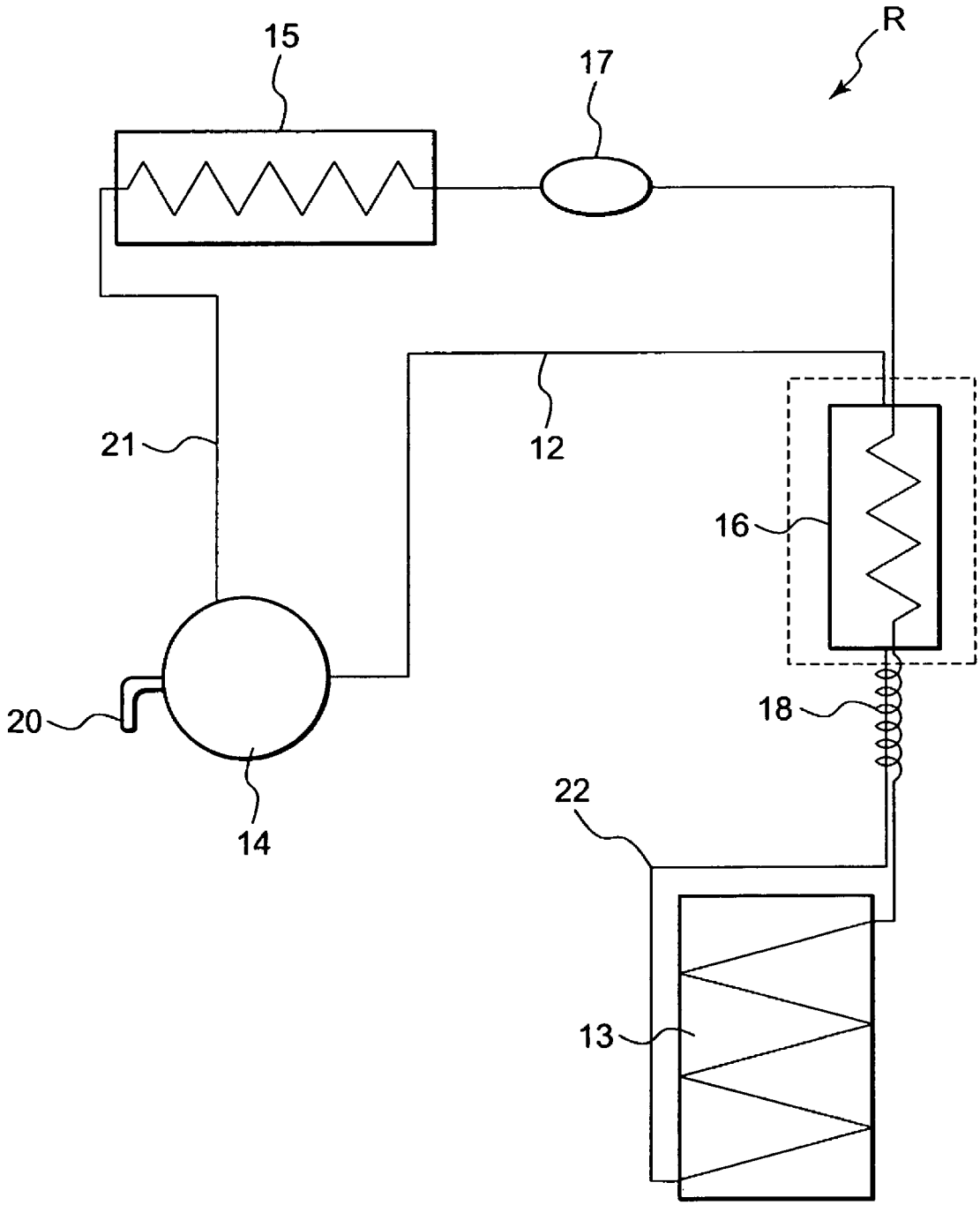
FIG. 6 is a refrigerant circuit diagram in the present embodiment.

Furthermore, an evaporator (refrigerant pipe) 13 constituting a refrigerant circuit of a freezing device R is heat-exchangeably attached to the peripheral surface of the inner box 4 on the side of the foamed insulating material 7. A mechanical chamber (not shown) is constituted in a lower part of the insulating box article 2. In this mechanical chamber, a compressor 14 and a condenser 15 are arranged to constitute a refrigerant circuit 12 of the freezing device R, and there is also disposed a blower (not shown) for air-cooling the compressor 14 and the condenser 15. Moreover, the compressor 14, the condenser 15, a drier 17, a heat exchanger 16, a capillary tube 18 as a pressure reducing unit and the evaporator 13 are successively annularly connected to one another by piping as shown in FIG. 6, thereby constituting the refrigerant circuit 12 of the freezing device R. It is to be noted that the heat exchanger 16 is disposed in the foamed insulating material 7.

FIG. 6 is a refrigerant circuit diagram in which the rotary compressor 14 is used. The compressor 14 is connected to a sub-cooler 20, and is constituted to discharge a refrigerant to a refrigerant discharge tube 21. The refrigerant has once released heat in the outside and thereafter returned into a shell of a sealed container to be compressed again. The compressor 14 on a discharge side is connected to the condenser 15 via the refrigerant discharge tube 21, and the condenser 15 on an outlet side is successively connected to the drier 17, the heat exchanger 16 and the capillary tube 18 as pressure reducing means. The capillary tube 18 on the outlet side is connected to the evaporator 13. The evaporator 13 on the outlet side is connected to the compressor 14 on a suction side via a return pipe 22 and the heat exchanger 16.

In the present embodiment, the refrigerant circuit 12 is filled with a mixed refrigerant of R245fa and R600, and a non-azeotropic mixture refrigerant of R23 and R14. The refrigerant R245f a is pentafluoropropane ($CHF_2CH_2CF_3$) having a boiling point of +15.3° C., and R600 is a butane ($C_4H_{10}$) having a boiling point of −0.5° C. The refrigerant R600 has a function of feeding a lubricant of the compressor 14 and a mixed moisture that cannot be absorbed by the drier 17 back into the compressor 14 in a state in which the lubricant and the moisture are dissolved in the refrigerant. However, R600 is a combustible substance. Therefore, when R600 is mixed with incombustible R245fa at a predetermined ratio of R245fa/R600=70/30 in the present embodiment, the mixture can be treated as an incombustible mixture. Moreover, R23 is trifluoromethane ($CHF_3$) having a boiling point of −82.1° C., and R14 is tetrafluoromenthane ($CF_4$) having a boiling point of −127.9° C.

Furthermore, in a composition of these mixed refrigerants in the present embodiment, the mixed refrigerant of R245fa and R600 occupies 64 wt % of the whole composition, R23 occupies 24 wt %, and R14 occupies 12 wt %.

In the above constitution, a high-temperature gas-like refrigerant discharged from the compressor 14 is once discharged from the sealed container to the sub-cooler 20 via the refrigerant discharge tube on the side of the sub-cooler 20. After releasing its heat, the refrigerant returns into the shell of the sealed container via a refrigerant suction tube. The high-temperature gas-like refrigerant which has once released its heat is compressed in the sealed container of the compressor 14 again, and thereafter discharged to the condenser 15 via the refrigerant discharge tube 21.

The high-temperature gas-like refrigerant which has flowed into the condenser 15 is condensed to release its heat, and liquefied. Thereafter, the moisture of the refrigerant is removed by the drier 17. The refrigerant then flows into the heat exchanger 16 to exchange the heat with a low-temperature refrigerant in the heat-exchangeably disposed return pipe 22. Accordingly, a high-pressure gas refrigerant from the compressor 14 is cooled. Therefore, the pressure of the mixed refrigerant passed through the heat exchanger 16 is reduced by the capillary tube 18. Subsequently, when the refrigerants successively flow into the evaporator 13, the refrigerants R14, R23 evaporate and absorb vaporization heat from a surrounding area to cool the evaporator 13. In this case, the temperature of the refrigerant can be lowered, and a condensing process can be promoted to enhance a cooling efficiency. The refrigerant is fed back to the compressor 14 via the heat exchanger 16 by the return pipe 22.

Consequently, it is possible to realize an extremely low temperature of −80° C. or less in the storage chamber 8. As described above, the thickness dimension of the foamed insulating material 7 of the insulating box article 2 forming the storage chamber 8 is set in accordance with the targeted temperature in the storage chamber 8 so that the temperature of the surface of the vacuum insulating panel 30 on the side of the inner box 4 is not less than the low-temperature-resistant limit temperature of the vacuum insulating panel 30. Therefore, while the destruction of the vacuum insulating panel 30 itself due to the low temperature is avoided in advance, it is possible to realize the reduction of the thickness dimension of the insulating box article 2 itself.

In consequence, it is possible to inhibit a disadvantage that the temperature of the outer surface of the outer box 3 is not more than the dew point. Therefore, even if the outer-shape dimension is similar to the conventional outer-shape dimension, it is possible to remarkably expand the storage volume of the storage chamber 8. Even in a case where the thickness dimension of the insulating box article 2 is reduced in this manner, since the insulating capability can be enhanced, it is possible to reduce a leakage of the cold in the storage chamber 8, and it is possible to reduce power consumption.

Furthermore, the insulating capability of the insulating box article 2 itself is enhanced. Therefore, in a case where the opening is disposed in the top as in the present embodiment, even when an opening close mechanism including the insulating door 9 to close the top opening is simplified, the leakage of the cold in the storage chamber 8 is not especially largely influenced. Therefore, even in the extremely-low-temperature storage in which the in-chamber temperature is set to −80° C. or less as in the present embodiment, it is not necessary to adopt a special opening structure. It is possible to simplify the whole structure, and reduction of costs can be realized.

What is claimed is:

1. A method of manufacturing a low-temperature storage comprising:

an insulating box article constituted by placing a foamed insulating material between an outer box and an inner box each having its top opened;

a storage chamber having its top opened provided in the inside of the inner box;

an insulating door attached to the top of the insulating box article via packing member so as to be rotatable centering on one end;

a lid constituted of an insulating material disposed so as to open or close an opening in the top of the storage chamber;

a refrigerant circuit constituted by successively annularly connecting a compressor, a condenser, a heat exchanger, a pressure reducing unit and an evaporator, the compressor and condenser are arranged in a mechanical chamber constituted in a lower part of the insulating box article, the evaporator is heat exchangeably attached to the peripheral surface of the inner box on the side of the foamed insulating material, the refrigerant circuit is filled with a non-azeotropic mixture refrigerant of R245fa, R600, R23 and R14; and a vacuum insulating panel disposed on the surface of the outer box on the side of the foamed insulating material, wherein a thickness dimension of the foamed insulating material between the inner box and the vacuum insulating panel is set so that a temperature of the surface of the vacuum insulating panel on the side of the inner box is not less than a predetermined temperature.

2. The method of manufacturing the low-temperature storage according to claim 1, wherein the thickness dimension of the foamed insulating material is set so that the temperature of the surface of the vacuum insulating panel on the side of the inner box is not less than −50° C. on conditions that a temperature in the inner box is −80° C. or less.

3. A low-temperature storage comprising:

an insulating box article constituted by placing a foamed insulating material between an outer box and an inner box each having its top opened; a storage chamber having its top opened provided in the inside of the inner box;

an insulating door attached to the top of the insulating box article via packing member so as to be rotatable centering on one end; a lid constituted of an insulating material disposed so as to open or close an opening in the top of the storage chamber;

a refrigerant circuit constituted by successively annularly connecting a compressor, a condenser, a heat exchanger, a pressure reducing unit and an evaporator, the compressor and condenser are arranged in a mechanical chamber constituted in a lower part of the insulating box article, the evaporator is heat exchangeably attached to the peripheral surface of the inner box on the side of the foamed insulating material, the refrigerant circuit is filled with a non-azeotropic mixture refrigerant of R245fa, R600, R23 and R14; and a vacuum insulating panel disposed in the foamed insulating material, wherein the thickness dimension of the foamed insulating material is set so that the temperature of the surface of the vacuum insulating panel on the side of the inner box is not less than a low-temperature-resistant limit temperature of the vacuum insulating panel on conditions that a temperature in the inner box is −80° C. or less.

4. The low-temperature storage according to claim 3, wherein the vacuum insulating panel is disposed on left and right side and front surface of the outer box on the side of the foamed insulating material.

5. The low-temperature storage according to claim 3 or claim 4, wherein the vacuum insulating panel is constituted by disposing a glass wool in a sealed vacuum container;

the formed insulating material is polyurethane resin insulating material; and the thickness dimension of the foamed insulating material is set so that the temperature of the surface of the vacuum insulating panel on the side of the inner box is not less than −60° C. on conditions that a temperature in the inner box is −80° C. or less.

* * * * *